US009494059B2

(12) United States Patent
Kim

(10) Patent No.: US 9,494,059 B2
(45) Date of Patent: Nov. 15, 2016

(54) VALVE TRAIN LAYOUT STRUCTURE INCLUDING RETURN SPRING AND CAMSHAFT-IN-CAMSHAFT

(71) Applicant: Hyundai Motor Company, Seoul (KR)

(72) Inventor: Hyounghyoun Kim, Hwaseong-Si (KR)

(73) Assignee: Hyundai Motor Company, Seoul (KR)

( * ) Notice: Subject to any disclaimer, the term of this patent is extended or adjusted under 35 U.S.C. 154(b) by 83 days.

(21) Appl. No.: 14/542,577

(22) Filed: Nov. 15, 2014

(65) Prior Publication Data

US 2015/0285107 A1 Oct. 8, 2015

(30) Foreign Application Priority Data

Apr. 2, 2014 (KR) ..... 10-2014-0039327

(51) Int. Cl.

| | |
|---|---|
| ***F01L 1/34*** | (2006.01) |
| ***F01L 1/344*** | (2006.01) |
| ***F01L 1/02*** | (2006.01) |
| ***F01L 1/047*** | (2006.01) |
| ***F01L 1/46*** | (2006.01) |

(52) U.S. Cl.

CPC ..... *F01L 1/344* (2013.01); *F01L 1/026* (2013.01); *F01L 1/047* (2013.01); *F01L 1/462* (2013.01)

(58) Field of Classification Search

CPC ..... F01L 1/344; F01L 1/026; F01L 1/047; F01L 1/462

USPC ..... 123/90.17

See application file for complete search history.

(56) References Cited

U.S. PATENT DOCUMENTS

2010/0126443 A1* 5/2010 Schneider ..... F01L 1/047 123/90.15
2010/0288229 A1* 11/2010 Lancefield ..... F01L 1/047 123/321
2011/0107992 A1* 5/2011 Murata ..... F02D 13/0238 123/90.17

FOREIGN PATENT DOCUMENTS

JP 2010-059854 A 3/2010
KR 10-2010-0096025 A 9/2010

* cited by examiner

*Primary Examiner* — Zelalem Eshete
(74) *Attorney, Agent, or Firm* — Morgan, Lewis & Bockius LLP

(57) ABSTRACT

A valve train layout structure may include a non-control camshaft adapted to not vary opening/closing timing of a valve, a control camshaft including an outer shaft, a first cam, an inner shaft rotatably inserted in the outer shaft, and a second cam fixed to the inner shaft and adapted to vary opening/closing timing of at least one of a valve activated by the first cam and a valve activated by the second cam by varying a phase between the first cam and the second cam, and a cam phaser including a rotor and a stator n which one of the rotor or the stator may be operatively connected to the outer shaft and the other of the rotor or the stator may be operatively connected to the inner shaft such that the cam phaser can vary the phase between the first cam and the second cam.

11 Claims, 6 Drawing Sheets

VALVE TRAIN LAYOUT STRUCTURE INCLUDING RETURN SPRING AND CAMSHAFT-IN-CAMSHAFT

CROSS-REFERENCE TO RELATED APPLICATION

The present application claims priority to Korean Patent Application Number 10-2014-0039327 filed Apr. 2, 2014, the entire contents of which is incorporated herein for all purposes by this reference.

BACKGROUND OF INVENTION

Field of Invention

The present invention relates to a valve train layout structure, and more particularly, to the valve train layout structure including a return spring and a camshaft-in-camshaft.

Description of Related Art

An internal combustion engine generates power by flowing fuels and air into combustion chambers and combusting them.

For combustion, an intake valve is opened by a driving camshaft and while the intake valve is opened, the air flows into the combustion chamber.

Further, an exhaust valve is opened by the driving camshaft after combustion and while the exhaust valve is opened, combustion gas is discharged out of the combustion chamber.

Optimum operation of an intake valve and an exhaust valve is adjusted depending on rotating speed of an engine.

This is because adequate valve lift or valve opening/closing time varies depending on the engine rotation speed.

Like this, the way of varying opening or closing time of an intake valve or an exhaust valve in accordance respectively with low speed or high speed of an engine in order to supplement the general drawbacks thereof is called variable valve timing (VVT) method.

Unlike a prior camshaft, a camshaft-in-camshaft comprises a hollow camshaft, namely an outer shaft and a different shaft inserted therein, namely an inner shaft.

There are two kinds in cam lobes of a camshaft-in-camshaft, one of which is a first cam fixed to an outer shaft and the other of which is a second cam fixed to an inner shaft and rotatable on the outer shaft.

A camshaft-in-camshaft structure has been devised so that among two types of valve connected thereto, a first type of valve is moved invariably in line with engine timing without special control and the movement of a second type of valve is controlled in order for the phase of the valve to become different from that of the first type of valve.

A cam phaser is the control apparatus which varies a phase between a first cam and a second cam.

By using the camshaft-in-camshaft and the cam phaser, continuous variable valve timing (CVVT) method can be realized.

A camshaft-in-camshaft in which a cam phaser varies a phase between a first cam and a second cam and thereby varies a phase between two valves is generally called a control camshaft.

It is generally the case that a cam phaser is mounted directly to a control camshaft to advance or retard (hereinafter, vary) an intake or an exhaust valve timing.

However, it occurs that a cam phaser can't be mounted directly to a control camshaft on account of a layout structure when an engine is mounted in a vehicle.

To overcome this, a major alteration for parts limiting the layout structure is needed. However, such an alteration is so big task that not only an engine system but also total package system of a vehicle must be changed. It comes close to a development project of a new engine.

In case of a modified engine, to cope with the above problem is practically almost impossible.

Accordingly, an alteration of a structure, a mounting place or a mounting method of a cam phaser is required and researches on this issue are being conducted.

In the meantime, when engine starting is off, a control camshaft generally stops with retarded valve timing on account of structural properties and inertia of a cam phaser.

As a result, a problem of unstable initial combustion happens because too much swirl is generated in cold starting of an engine.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a valve train layout structure securing good startability and stability of initial combustion in various types of variable valve timing systems according to alterations of a structure and a position of a cam phaser.

According to various aspects of the present invention, a valve train layout structure may include a non-control camshaft connected to a chain sprocket rotating in line with engine timing and adapted to not vary opening/closing timing of a valve, a control camshaft including an outer shaft, a first cam fixed to the outer shaft, an inner shaft rotatably inserted in the outer shaft, and a second cam fixed to the inner shaft and the control camshaft adapted to vary opening/closing timing of at least one of a valve activated by the first cam and a valve activated by the second cam by varying a phase between the first cam and the second cam, and a cam phaser including a rotor and a stator relatively rotatable with respect to each other in which one of the rotor or the stator may be operatively connected to the outer shaft and the other of the rotor or the stator may be operatively connected to the inner shaft such that the cam phaser varies the phase between the first cam and the second cam.

The valve train layout structure may further include a return spring providing a restoring force in order for the phase between the first cam and the second cam to return to a predetermined initial phase when an engine stops.

The rotor may be driven in line with the engine timing and the stator may be relatively rotatable with respect to the rotor.

One side portion of the outer shaft may be fitted with a first driven gear and one side portion of the inner shaft may be fitted with a second driven gear and the rotor may be fitted with a first driving gear engaging with one of the first driven gear or the second driven gear, and the stator may be fitted with a second driving gear engaging with the other of the first driven gear or the second driven gear.

The rotor may be fixedly connected with the chain sprocket, the first driving gear may engage with the second driven gear, and the second driving gear may engage with the first driven gear.

A return spring may provide a restoring force in order for the phase between the first cam and the second cam to return to a predetermined initial phase when an engine stops, and the return spring may be mounted in a space between the first driving gear and the second driving gear constituting a first pair or a space between the first driven gear and the second driven gear constituting a second pair.

One end of the return spring may be supported by a first support portion formed at the second driving gear or the first driven gear and the other end of the return spring may be supported by a second support portion formed at each one of the first and second pairs rotating in line with the engine timing, the non-control camshaft, or the inner shaft.

The first support portion and the second support portion may be a hole, a protrusion, a pin, or a bolt.

The rotor may be fixedly connected with the chain sprocket, the first driving gear may engage with the first driven gear and the second driving gear may engage with the second driven gear.

The valve train layout structure may further include a return spring providing a restoring force in order for the phase between the first cam and the second cam to return to a predetermined initial phase when an engine stops, in which the return spring may be mounted in a space between the first driving gear and the second driving gear constituting a first pair or a space between the first driven gear and the second driven gear constituting a second pair.

One end of the return spring may be supported by a first support portion formed at the second driving gear or the second driven gear and the other end of the return spring may be supported by a second support portion formed at each one of the first and second pairs rotating in line with the engine timing, the non-control camshaft, or the outer shaft.

The stator may be driven in line with the engine timing and the rotor may be relatively rotatable with respect to the stator.

The stator may be fixedly connected with the chain sprocket, the first driving gear may engage with the second driven gear and the second driving gear may engage with the first driven gear.

One end of the return spring may be supported by a first support portion formed at the first driving gear or the second driven gear and the other end of the return spring may be supported by a second support portion formed at each one of the first and second pairs rotating in line with the engine timing, the non-control camshaft, or the outer shaft.

The stator may be fixedly connected with the chain sprocket, the first driving gear may engage with the first driven gear and the second driving gear may engage with the second driven gear.

One end of the return spring may be supported by a first support portion formed at the first driving gear or the first driven gear and the other end of the return spring may be supported by a second support portion formed at each one of the first and second pairs rotating in line with the engine timing, the non-control camshaft, or the inner shaft.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In addition, unless explicitly described to the contrary, the word "comprise" and variations such as "comprises" or "comprising" will be understood to imply the inclusion of stated elements but not the exclusion of any other elements and the name of a component doesn't set limits to the function of the component concerned.

Figure 1:
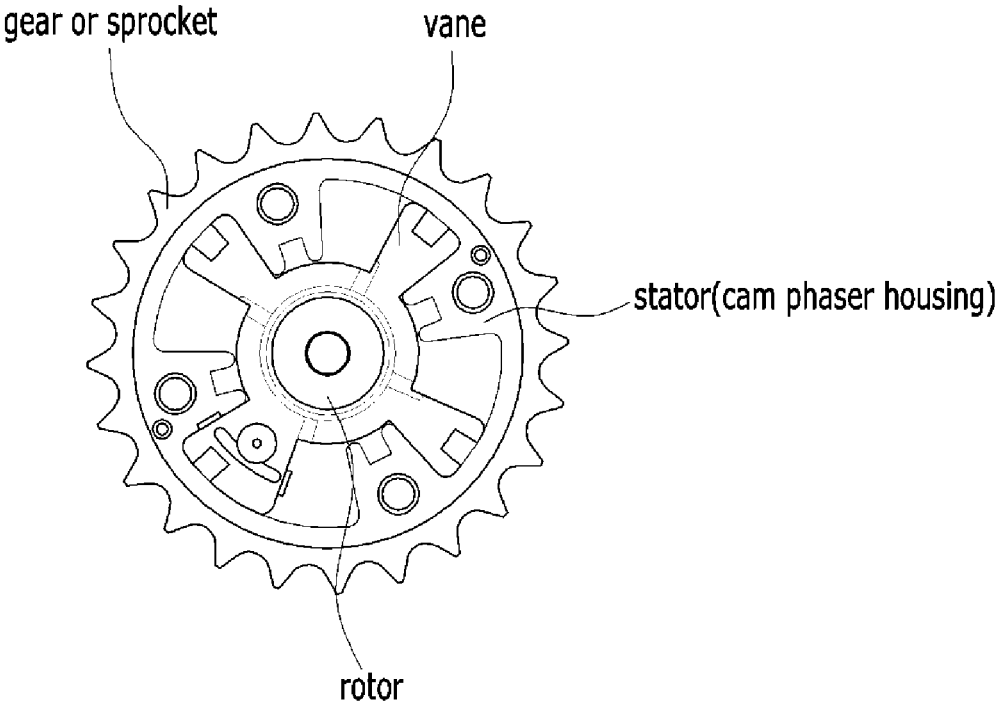
FIG. 1 (Related Art)
FIG. 1 is a schematic diagram of a cam phaser in the related art.

FIG. 1 is a schematic diagram of a cam phaser.

Figure 2A:
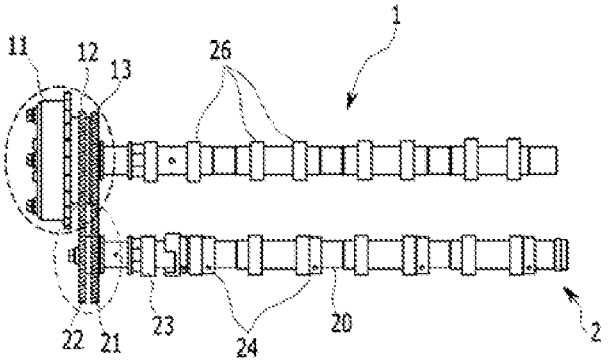
FIG. 2A, FIG. 2B and FIG. 2C are drawings which show an exemplary valve train layout structure (phasing by an outer shaft) according to the present invention.
Figure 2B:
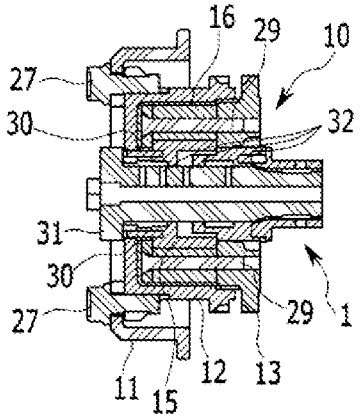
Figure 3A:
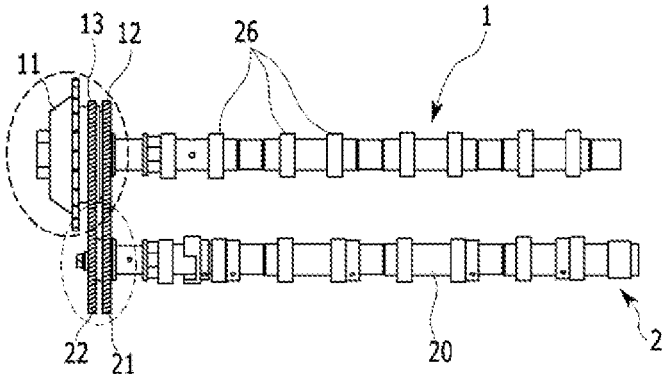
FIG. 3A, FIG. 3B and FIG. 3C are drawings which show an exemplary valve train layout structure (phasing by an inner shaft) according to the present invention.
Figure 3B:
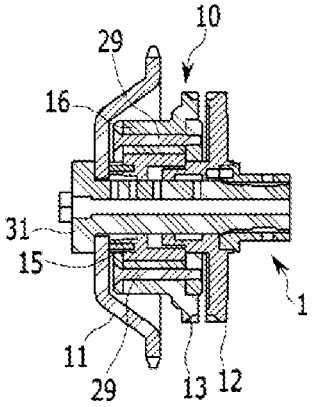

In general, a cam phaser, a reference number of which is 10 in FIG. 2B and FIG. 3B, comprises a rotor a reference number of which is 15 in FIG. 2B and FIG. 3B, a stator a reference number of which is 16 in FIG. 2B and FIG. 3B, and vanes. The stator may function as a cam phaser housing, too.

The cam phaser 10 may be fitted with a gear or a chain sprocket 11.

The chain sprocket 11 transmits engine power in line with engine timing by engaging with a chain driven by an engine crankshaft which is a driving shaft of the chain.

The cam phaser 10 is constituted or configured such that one of the rotor 15 and the stator 16 is driven with engine timing by being fixed to the chain sprocket 11 and the other of the rotor 15 and the stator 16 is rotatable relatively to the one fixed to the chain sprocket 11.

The rotor 15 or the stator 16 may be driven by a hydraulic pressure type control apparatus or an electronic driving apparatus and thereby the relative rotating motion may be generated.

Figure 2C:
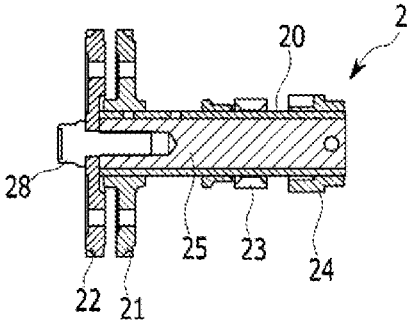
Figure 3C:
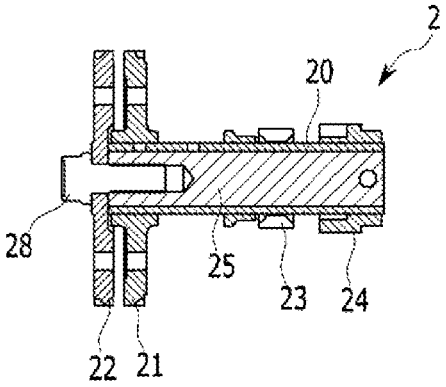

One of the rotor 15 and the stator 16 may be operatively connected to an outer shaft a reference number of which is 20 in FIG. 2C and FIG. 3C, the other of the rotor 15 and the stator 16 may be operatively connected to an inner shaft a reference number of which is 25 in FIG. 2C and FIG. 3C, and thereby the cam phaser 10 may be operatively connected to a control camshaft a reference number of which is 2 in FIG. 2A, FIG. 3A, FIG. 4A and FIG. 5A. In this case, the control camshaft is a camshaft-in-camshaft.

By this, a relative rotating motion can be generated between a first cam a reference number of which is 23 in FIG. 2A and FIG. 3A and a second cam a reference number of which is 24 in FIG. 2C and FIG. 3C and a variable valve timing method can be realized.

Referring to FIG. 2A, FIG. 2B and FIG. 2C, a valve train layout structure according to various embodiments of the present invention may comprise a non-control camshaft 1, a control camshaft 2, a cam phaser 10, and a chain sprocket 11.

The non-control camshaft 1 may be fixedly connected to the chain sprocket 11 rotating in line with engine timing and operates in fixed timing such that opening/closing timing of a valve connected to the non-control camshaft does not vary.

The control camshaft 2 is a camshaft-in-camshaft and comprises an outer shaft 20, a first cam 23 fixed to the outer shaft 20, an inner shaft 25 rotatably inserted in the outer shaft 20, and a second cam 24 fixed to the inner shaft 25 and rotatable on the outer shaft 20.

The control camshaft 2 can vary opening/closing timing of at least one of a valve activated by the first cam 23 and a valve activated by the second cam 24 by varying a phase between the first cam 23 and the second cam 24.

The cam phaser 10 comprises a rotor 15 and a stator 16.

The rotor 15 and the stator 16 may be rotatable relatively to each other, one of the rotor 15 and stator 16 is operatively connected to the outer shaft 20, and the other of the rotor 15 and stator 16 is operatively connected to the inner shaft 25.

Referring to FIG. 2A, FIG. 2B and FIG. 2C, the connections may be realized by gears.

That is, the cam phaser 10 is fixedly combined or coupled with the non-control camshaft 1, the rotor 15 is fitted with a first driving gear 12, and the stator 16 is fitted with a second driving gear 13.

Referring to FIG. 2A, FIG. 2B and FIG. 2C, it is understood that the rotor 15 and the first driving gear 12 are fixedly combined or coupled by a fixing pin 30 in a rotating direction.

Accordingly, the rotor 15 and the first driving gear 12 have a same phase in the rotating direction.

The first driving gear 12 and the second driving gear 13 engage respectively with a second driven gear 22 mounted on one side portion of the inner shaft 25 and a first driven gear 21 mounted on one side portion of the outer shaft 20.

By the gears above, the rotor 15 is operatively connected to the inner shaft 25 and the stator 16 is operatively connected to the outer shaft 20.

The chain sprocket 11 is fixedly combined or coupled with the rotor 15 and the non-control camshaft 1 by a cam phaser bolt 31 and with the first driving gear 12 by a chain sprocket bolt 27.

The chain sprocket 11 is driven by a chain and rotates in line with engine timing.

Accordingly, the rotor 15, the non-control camshaft 1 and the first driving gear 12 are driven fixedly in the engine timing.

Hereinafter, referring to FIG. 2A, FIG. 2B, and FIG. 2C, an operation principle will be explained, by which a valve train layout structure according to various embodiments the present invention varies the opening/closing timing of a valve operatively connected to the control camshaft 2.

The stator 16 is driven in line with the engine timing by the fixing pin 30 and at the same time installed such that the stator 16 is rotatable relatively to the rotor 15. Accordingly, the stator 16 rotates relatively to the rotor 15 by pressure of oil flowing inside through oil holes 32 formed at the cam phaser bolt 31, and thereby variance of the phase between the rotor 15 and the stator 16 is generated.

Because the rotor 15 is operatively connected to the inner shaft 25 by the engagement of the first driving gear 12 and the second driven gear 22, the inner shaft 25 is driven fixedly in the engine timing.

Accordingly, the outer shaft 20 is operatively connected to the stator 16 by the engagement of the second driving gear 13 and the first driven gear 21. As the stator 16 operates by a hydraulic pressure type control apparatus and the phase of the outer shaft 20 varies, the opening/closing timing of a valve operatively connected to the control camshaft 2 varies.

That is, the varying method of valve timing is a method phasing by the outer shaft 20.

Meanwhile, as mentioned earlier, in various embodiments of the valve train being installed such that the rotor 15 is rotatable relatively to the stator 16, it is obvious that the varying method of valve timing can be a method phasing by the inner shaft 25 with the same or similar structure. Since the structure is the same or similar, detailed explanation will be omitted.

FIG. 3A, FIG. 3B and FIG. 3C are drawings which show a valve train layout structure (phasing by an inner shaft) according to various embodiments of the present invention.

In the valve train layout structure, constituting elements are the same as in the valve train layout structure according to previously described embodiments of the present invention.

However, the cam phaser 10 and the gears are constituted or configured such that the order of the first driving gear 12 and the second driving gear 13 positioned on one side portion of the non-control camshaft 1 is reversed.

On account of a characteristic of a camshaft-in-camshaft, the order of the first driven gear 21 and the second driven gear 22 on the one side portion of the control camshaft 2 is the same as in the first valve train layout structure.

Hereinafter, referring to FIG. 3A, FIG. 3B and FIG. 3C, an operation principle will be explained, by which the valve train layout structure according to various embodiments of the present invention varies the opening/closing timing of a valve operatively connected to the control camshaft 2.

The stator 16 is driven in line with the engine timing by the fixing pin 30 and at the same time installed such that the stator 16 is rotatable relatively to the rotor 15. Accordingly, the stator 16 rotates relatively to the rotor 15 by pressure of oil flowing inside through oil holes 32 formed at the cam phaser bolt 31, and thereby variance of the phase between the rotor 15 and the stator 16 is generated.

But, different than in the valve train layout structure described in previous embodiments, the order of the first driving gear 12 and the second driving gear 13 is reversed.

Because the rotor 15 is operatively connected to the outer shaft 20 by the engagement of the first driving gear 12 and the first driven gear 21, the outer shaft 20 is driven fixedly in the engine timing.

Accordingly, the inner shaft 20 is operatively connected to the stator 16 by the engagement of the second driving gear 13 and the second driven gear 22. As the stator 16 operates by a hydraulic pressure type control apparatus and the phase of the inner shaft 25 varies, the opening/closing timing of a valve operatively connected to the control camshaft 2 varies.

That is, the varying method of valve timing is a method phasing by the inner shaft 25.

Meanwhile, as mentioned earlier, in various embodiments of the valve train installed such that the rotor 15 is rotatable relatively to the stator 16, it is obvious that the varying method of valve timing can be a method phasing by the outer shaft 20 with the same or similar structure. Since the structure is the same or similar, detailed explanation will be omitted.

Referring to FIG. 4A, FIG. 4B and FIG. 4C and FIG. 5A, FIG. 5B and FIG. 5C, methods to install a return spring 35 in various embodiments according to the present invention will be explained as follows.

First, the reason why the return spring 35 is installed is because a relative phase between the outer shaft 20 and the inner shaft 25 constituting the control camshaft 2 is generally retarded when engine starting is off.

The retardation happens because rotational inertia acts in a reverse direction when the starting is off and thereby oil pressure in the cam phaser 10 rapidly gets out.

Of course, there can be a case in which the relative phase between the outer shaft 20 and the inner shaft 25 is advanced.

This eventually depends on whether the first cam 23 and the second cam 24 are advanced or retarded with respect to each other right before the engine starting is off.

The former is generally the case in actual driving condition. Accordingly, the control camshaft 2 is generally in the condition of the phase retarded when the starting is off.

Therefore, the return spring 35 is mounted to advance the retarded phase of the control camshaft 2 back to a default condition.

Of course, in case the phase is advanced right before engine starting is off, the return spring 35 plays a role of retarding the phase back to a default condition.

In this case, the return spring 35 may be designed to have a rotational stiffness such that a relative angular position between the first cam 23 and the second cam 24 becomes zero degree when engine starting is off and thereby oil pressure in the cam phaser 10 gets out.

Through this, the return spring 35 can apply restoring force to make the relative angular position between the first cam 23 and the second cam 24 become a default phase of zero degree.

Or the default phase may be arbitrarily set to be +10 degrees, +20 degrees, −10 degrees, or −20 degrees, etc.

A plus sign of a phase stands for advanced phase condition and a minus sign of a phase, retarded phase condition.

Therefore, a return spring 35 according to various embodiments of the present invention may have an arbitrary rotational stiffness such that a phase between the first cam 23 and the second cam 24 becomes a default phase predetermined by a designer when engine starting is off.

Figure 4A:
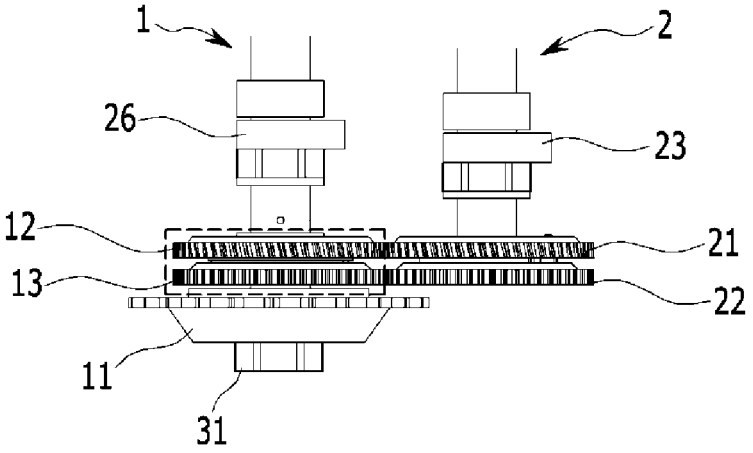
FIG. 4A, FIG. 4B and FIG. 4C show drawings in which a return spring is mounted between a pair of driving gears according to the present invention.
Figure 5A:
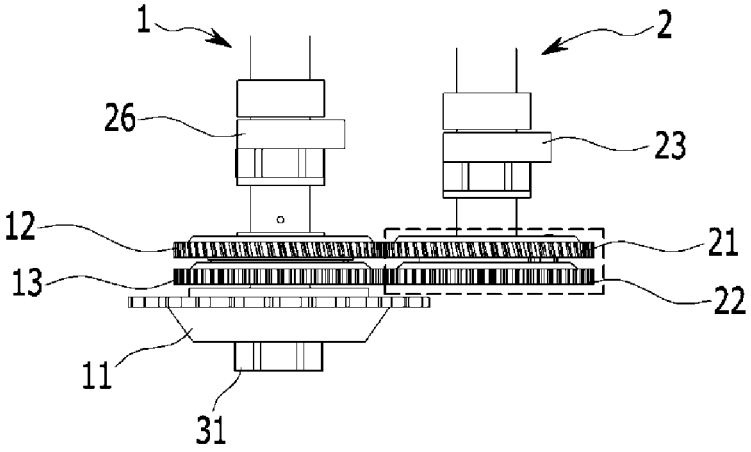
FIG. 5A, FIG. 5B and FIG. 5C show drawings in which a return spring is mounted between a pair of driven gears according to the present invention.

Mounting methods of the return spring 35 may include a method of positioning the return spring 35 between driving gears constituting a pair (a box portion with dotted line) as shown in FIG. 4A and a method of positioning the return spring 35 between driven gears constituting a pair (a box portion with dotted line) as shown in FIG. 5A.

Using these methods, the return spring 35 can be mounted through using only an existing space without a change of manufacturing method for chain sprocket 11 or an addition of a needed space.

Upper parts of FIG. 4A, FIG. 4B and FIG. 4C, FIG. 5A, FIG. 5B and FIG. 5C are showing conditions in which the rotor 15 and the outer shaft 20 are operatively connected and the stator 16 and the inner shaft 25 are operatively connected by engaging a first and a second driving gear, 12 and 13, respectively with a first and a second driven gear, 21 and 22 in a second valve train layout structure of FIG. 3A, FIG. 3B and FIG. 3C.

Figure 4B:
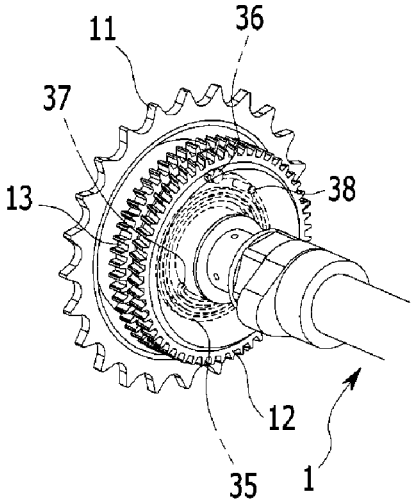
Figure 4C:
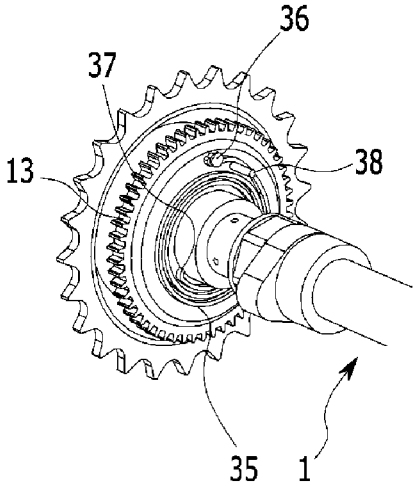

In various embodiment of FIG. 4A, FIG. 4B and FIG. 4C, phasing by inner shaft is realized through the stator 16 because the rotor 15 is assumed to be driven fixedly in line with engine timing.

Referring FIG. 4B and FIG. 4C, one end of the return spring 35 may be supported by a first support portion 36 and the other end thereof, by a second support portion 37.

In FIG. 4B, the first driving gear 12 is shown and the return spring 35 therewithin is drawn in dotted lines. In FIG. 4C, the first driving gear 12 is not shown and the return spring 35 is drawn in solid lines.

The first support portion 36 may be a hole, a protrusion, a pin, or a bolt formed or mounted on the second driving gear 13 and is a protrusion with a head portion, a pin pressed in, or a bolt in various embodiments of FIG. 4A, FIG. 4B and FIG. 4C.

The second support portion 37 may be a hole, a protrusion, a pin, or a bolt formed or mounted on the non-control camshaft and placed in a space between the first driving gear 12 and the second driving gear 13 and is a hole in various embodiments of FIG. 4A, FIG. 4B and FIG. 4C.

Or the second support portion 37 may be formed or mounted on the first driving gear 12 as the first support portion 36 is formed on the second driving gear 13 in FIG. 4A, FIG. 4B and FIG. 4C.

That is, both ends of the return spring 35 may be respectively mounted to two holes, two protrusions with head portions, two pins pressed in, or two bolts formed or mounted respectively at a second driving gear and a first driving gear facing each other.

The first support portion 36 and the second support portion 37 are not limited to those of various embodiments in FIG. 4A, FIG. 4B and FIG. 4C.

In general, the first support portion 36 may be formed at a structure driven not fixedly in line with engine timing but in phase variable timing.

On the contrary, the second support portion 37 may be formed at a structure fixedly in line with engine timing.

For example, at one of driving gears driven in phase variable timing may a first support portion 36 be formed, and at the other of driving gears driven fixedly in line with engine timing may a second support portion 37 be formed.

In addition, a second support portion 37 may also be formed not at the other driving gear driven in fixed engine timing but on a non-control camshaft 1 driven in fixed engine timing as in various embodiments of FIG. 4A, FIG. 4B and FIG. 4C.

Figure 5B:
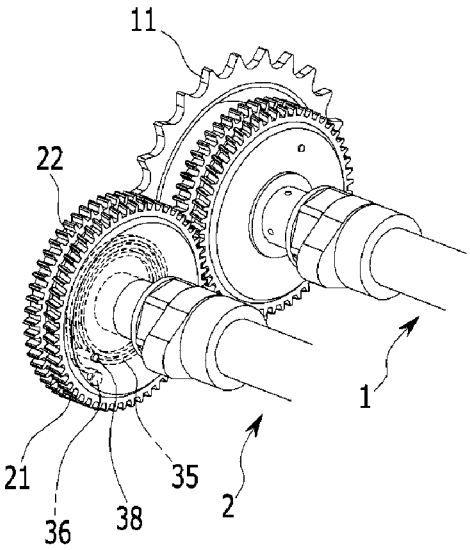
Figure 5C:
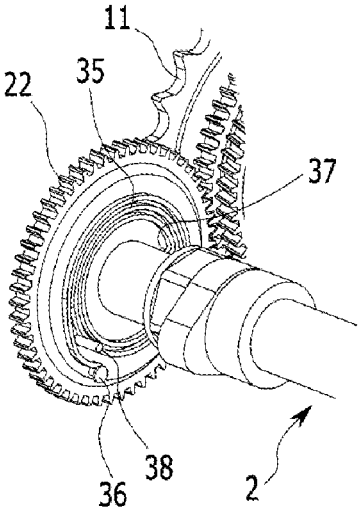

Referring to FIG. 5B and FIG. 5C, one end of the return spring 35 may be supported by a first support portion 36 and the other end thereof, by a second support portion 37 also in this case.

In FIG. 5B, the first driven gear 21 is shown and the return spring 35 therewithin is drawn in dotted line. In FIG. 5C, the first driven gear 21 is not shown and the return spring 35 is drawn in solid line.

The first support portion 36 may be a hole, a protrusion, a pin, or a bolt formed or mounted on the second driven gear 22 driven in phase variable timing and is a protrusion with a head portion, a pin pressed in, or a bolt in various embodiments of FIG. 5A, FIG. 5B and FIG. 5C.

The second support portion 37 may be a hole, a protrusion, a pin, or a bolt formed or mounted on the outer shaft 20 of the control camshaft 2 driven in fixed engine timing and placed in a space between the first driven gear 21 and the second driven gear 22 and is a hole in various embodiments of FIG. 5A, FIG. 5B and FIG. 5C.

Or the second support portion 37 may be formed or mounted on the first driven gear 21 as the first support portion 36 is formed on the second driven gear 22 in FIG. 5A, FIG. 5B and FIG. 5C.

That is, both ends of the return spring 35 may be respectively mounted to two holes, two protrusions with head portions, two pins pressed in, or two bolts formed or mounted respectively at a second driven gear and a first driven gear facing each other.

The first support portion 36 and the second support portion 37 are not limited to those of various embodiments in FIG. 5A, FIG. 5B and FIG. 5C.

In general, the first support portion 36 may be formed at a structure driven not fixedly in line with engine timing but in phase variable timing.

On the contrary, the second support portion 37 may be formed at a structure fixedly in line with engine timing.

For example, at one of driven gears driven in phase variable timing may a first support portion 36 be formed, and at the other of driving gears driven fixedly in line with engine timing may a second support portion 37 be formed.

In addition, a second support portion 37 may also be formed not at the other driven gear driven in fixed engine timing but on the control camshaft 2 driven in fixed engine timing, that is, the outer shaft 20 as in various embodiments of FIG. 5A, FIG. 5B and FIG. 5C.

A guiding pin 38 plays a role of preventing the return spring 35 from being unnecessarily blocked in a radial direction in FIG. 4A, FIG. 4B, FIG. 4C, FIG. 5A, FIG. 5B and FIG. 5C.

As stated in detail above, according to the present invention, in case a cam phaser can't be mounted directly to a control camshaft on account of changes of a vehicle body layout or an engine room package, not only the problem can be solved with the altered valve train layout structure but also startability of the engine and stability of initial combustion can be obtained.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A valve train layout structure comprising:

a non-control camshaft connected to a chain sprocket rotating in line with engine timing and adapted to not vary opening/closing timing of a valve;

a control camshaft including an outer shaft, a first cam fixed to the outer shaft, an inner shaft rotatably inserted in the outer shaft, and a second cam fixed to the inner shaft and adapted to vary opening/closing timing of at least one of a valve activated by the first cam and a valve activated by the second cam by varying a phase between the first cam and the second cam;

a cam phaser including a rotor and a stator relatively rotatable with respect to each other, wherein one of the rotor or the stator is operatively connected to the outer shaft and the other of the rotor or the stator is operatively connected to the inner shaft such that the cam phaser varies the phase between the first cam and the second cam; and a return spring, wherein the rotor is driven in line with the engine timing and the stator is relatively rotatable with respect to the rotor, and wherein the return spring is mounted in a space between the first driving gear and the second driving gear constituting a first pair or a space between the first driven gear and the second driven gear constituting a second pair.

2. The valve train layout structure of claim 1, wherein one end of the return spring is supported by a first support portion formed at the second driving gear or the first driven gear and the other end of the return spring is supported by a second support portion formed at each one of the first and second pairs rotating in line with the engine timing, the non-control camshaft, or the inner shaft.

3. The valve train layout structure of claim 2, wherein the first support portion and the second support portion are a hole, a protrusion, a pin, or a bolt.

4. A valve train layout structure comprising:

a non-control camshaft connected to a chain sprocket rotating in line with engine timing and adapted to not vary opening/closing timing of a valve;

a control camshaft including an outer shaft, a first cam fixed to the outer shaft, an inner shaft rotatably inserted in the outer shaft, and a second cam fixed to the inner shaft and adapted to vary opening/closing timing of at least one of a valve activated by the first cam and a valve activated by the second cam by varying a phase between the first cam and the second cam;

a cam phaser including a rotor and a stator relatively rotatable with respect to each other, wherein one of the rotor or the stator is operatively connected to the outer shaft and the other of the rotor or the stator is operatively connected to the inner shaft such that the cam phaser varies the phase between the first cam and the second cam; and a return spring, wherein the rotor is driven in line with the engine timing and the stator is relatively rotatable with respect to the rotor, wherein one side portion of the outer shaft is fitted with a first driven gear and one side portion of the inner shaft is fitted with a second driven gear, wherein the rotor is fitted with a first driving gear engaging with one of the first or the second driven gear and the stator is fitted with a second driving gear engaging with the other of the first or the second driven gear, wherein the rotor is fixedly connected with the chain sprocket, the first driving gear engages with the first driven gear and the second driving gear engages with the second driven gear, and wherein the return spring is mounted in a space between the first driving gear and the second driving gear constituting a first pair or a space between the first driven gear and the second driven gear constituting a second pair.

5. The valve train layout structure of claim 4, wherein the rotor is fixedly connected with the chain sprocket, the first driving gear engages with the second driven gear and the second driving gear engages with the first driven gear.

6. The valve train layout structure of claim 4, wherein one end of the return spring is supported by a first support portion formed at the second driving gear or the second driven gear and the other end of the return spring is supported by a second support portion formed at each one of the first and second pairs rotating in line with the engine timing, the non-control camshaft, or the outer shaft.

7. A valve train layout structure comprising:

a non-control camshaft connected to a chain sprocket rotating in line with engine timing and adapted to not vary opening/closing timing of a valve;

a control camshaft including an outer shaft, a first cam fixed to the outer shaft, an inner shaft rotatably inserted in the outer shaft, and a second cam fixed to the inner shaft and adapted to vary opening/closing timing of at least one of a valve activated by the first cam and a valve activated by the second cam by varying a phase between the first cam and the second cam;

a cam phaser including a rotor and a stator relatively rotatable with respect to each other, wherein one of the rotor or the stator is operatively connected to the outer shaft and the other of the rotor or the stator is operatively connected to the inner shaft such that the cam phaser varies the phase between the first cam and the second cam; and a return spring, wherein the stator is driven in line with the engine timing and the rotor is relatively rotatable with respect to the stator, wherein one side portion of the outer shaft is fitted with a first driven gear and one side portion of the inner shaft is fitted with a second driven gear, wherein the rotor is fitted with a first driving gear engaging with one of the first or the second driven gear and the stator is fitted with a second driving gear engaging with the other of the first or the second driven gear, wherein the stator is fixedly connected with the chain sprocket, the first driving gear engages with the second driven gear and the second driving gear engages with the first driven gear, and wherein the return spring is mounted in a space between the first driving gear and the second driving gear constituting a first pair or a space between the first driven gear and the second driven gear constituting a second pair.

8. The valve train layout structure of claim 7, wherein one end of the return spring is supported by a first support portion formed at the first driving gear or the second driven gear and the other end of the return spring is supported by a second support portion formed at each one of the first and second pairs rotating in line with the engine timing, the non-control camshaft, or the outer shaft.

9. The valve train layout structure of claim 8, wherein the first support portion and the second support portion are a hole, a protrusion, a pin, or a bolt.

10. A valve train layout structure comprising:

a non-control camshaft connected to a chain sprocket rotating in line with engine timing and adapted to not vary opening/closing timing of a valve;

a control camshaft including an outer shaft, a first cam fixed to the outer shaft, an inner shaft rotatably inserted in the outer shaft, and a second cam fixed to the inner shaft and adapted to vary opening/closing timing of at least one of a valve activated by the first cam and a valve activated by the second cam by varying a phase between the first cam and the second cam; and a cam phaser including a rotor and a stator relatively rotatable with respect to each other, wherein one of the rotor or the stator is operatively connected to the outer shaft and the other of the rotor or the stator is operatively connected to the inner shaft such that the cam phaser varies the phase between the first cam and the second cam; and a return spring, wherein the stator is driven in line with the engine timing and the rotor is relatively rotatable with respect to the stator, wherein one side portion of the outer shaft is fitted with a first driven gear and one side portion of the inner shaft is fitted with a second driven gear, wherein the rotor is fitted with a first driving gear engaging with one of the first or the second driven gear and the stator is fitted with a second driving gear engaging with the other of the first or the second driven gear, wherein the stator is fixedly connected with the chain sprocket, the first driving gear engages with the first driven gear and the second driving gear engages with the second driven gear, and wherein the return spring is mounted in a space between the first driving gear and the second driving gear constituting a first pair or a space between the first driven gear and the second driven gear constituting a second pair.

11. The valve train layout structure of claim 10, wherein one end of the return spring is supported by a first support portion formed at the first driving gear or the first driven gear and the other end of the return spring is supported by a second support portion formed at each one of the first and second pairs rotating in line with the engine timing, the non-control camshaft, or the inner shaft.

* * * * *